United States Patent [19]

Mount

[11] Patent Number: 4,535,598

[45] Date of Patent: Aug. 20, 1985

[54] METHOD AND CONTROL SYSTEM FOR VERIFYING SENSOR OPERATION IN A REFRIGERATION SYSTEM

[75] Inventor: Gordon L. Mount, West Monroe, N.Y.

[73] Assignee: Carrier Corporation, Syracuse, N.Y.

[21] Appl. No.: 610,058

[22] Filed: May 14, 1984

[51] Int. Cl.[3] ..... F25B 49/00

[52] U.S. Cl. ..... 62/126; 62/201; 62/226

[58] Field of Search ..... 62/125, 126, 127, 129, 62/130, 230, 228.3, 201, 226, 229, 215, 185, 180, 228.1; 165/11 R; 236/94

[56] References Cited

U.S. PATENT DOCUMENTS

| | | | |
|---|---|---|---|
| 3,587,290 | 6/1971 | Beauchamp et al. | 73/1 R |
| 3,772,667 | 11/1973 | Falck, Jr. | 340/217 |
| 3,946,573 | 3/1976 | Nichols et al. | 62/126 |
| 4,060,997 | 12/1977 | Shultz et al. | 62/185 X |
| 4,118,688 | 10/1978 | Glennon | 340/52 |
| 4,214,227 | 7/1980 | Papasideris | 340/52 |
| 4,222,031 | 9/1980 | Okamoto et al. | 340/52 |
| 4,243,971 | 1/1981 | Suchowerskyj | 340/52 |
| 4,283,720 | 8/1981 | Herledan | 340/653 |
| 4,298,334 | 11/1981 | Clark et al. | 431/24 |
| 4,333,316 | 6/1982 | Stamp, Jr. et al. | 62/160 X |
| 4,381,549 | 4/1983 | Stamp, Jr. et al. | 165/11 R X |
| 4,387,578 | 6/1983 | Paddock | 62/127 |
| 4,432,210 | 2/1984 | Saito | 62/126 |
| 4,459,815 | 7/1984 | Yokoyama | 62/185 X |

*Primary Examiner*—Harry B. Tanner

*Attorney, Agent, or Firm*—Douglas L. Miller

[57] ABSTRACT

A method and control system are disclosed for checking and verifying sensor operation in a refrigeration system. A microcomputer control system determines whether a signal provided by the sensor is within normal limits prior to startup of the refrigeration system. Also, the microcomputer system verifies an out of bounds sensor signal provided to the microcomputer system from the sensor during operation of the refrigeration system by intermittently monitoring the sensor to determine whether a preselected consecutive number of out of bounds signals are provided to the microcomputer control system from the sensor. If the microcomputer control system determines that the signal provided by the sensor is not within normal limits prior to startup of the refrigeration system, or if the microcomputer system verifies an out of bounds signal provided by the sensor during operation of the refrigeration system, then the microcomputer control system generates an alarm signal to abort the startup or shut down the operation of the refrigeration system, respectively.

9 Claims, 1 Drawing Figure

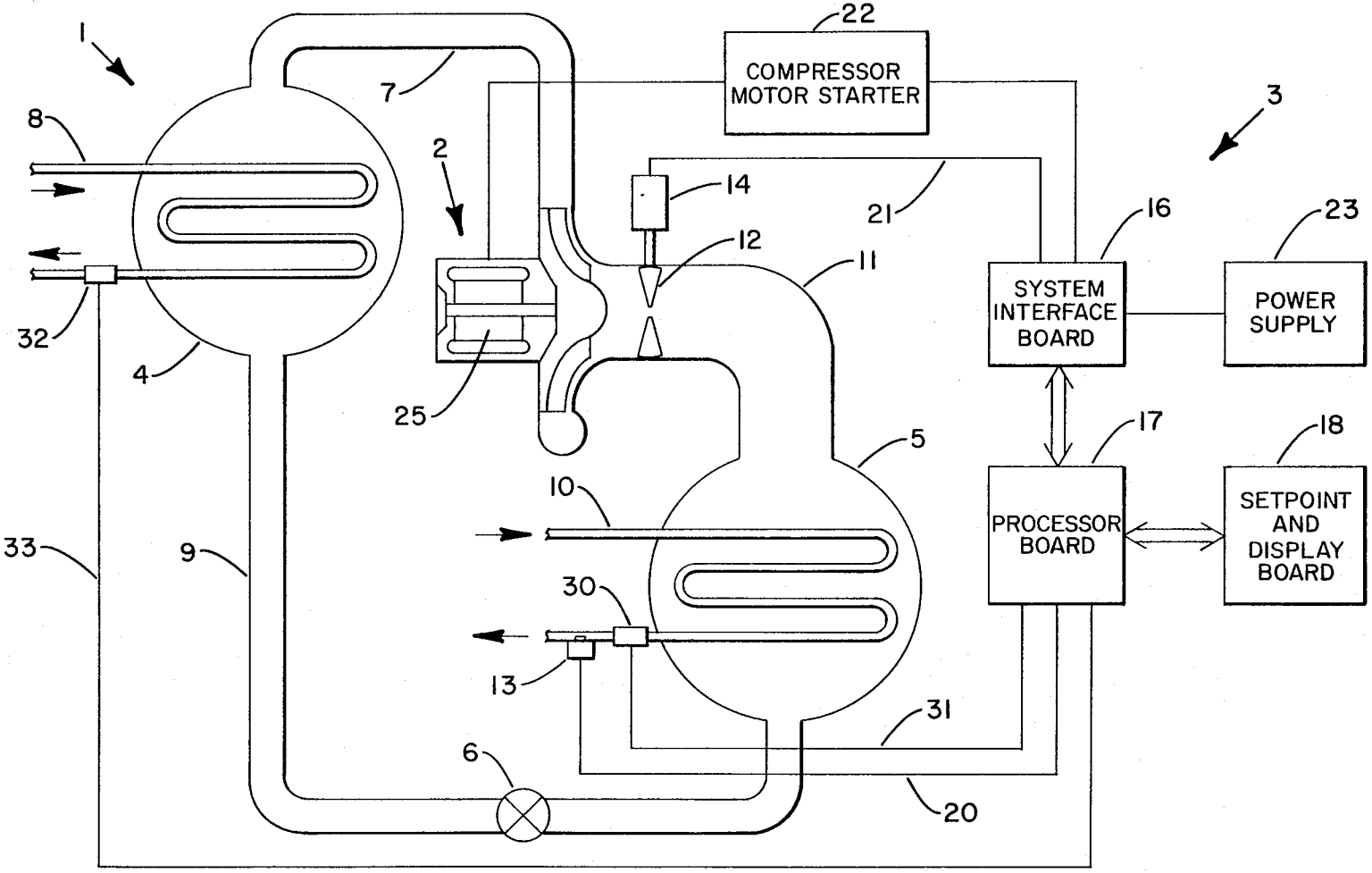
POWER SUPPLY
SETPOINT AND DISPLAY BOARD
SYSTEM INTERFACE BOARD
PROCESSOR BOARD
COMPRESSOR MOTOR STARTER
3
23
18
16
17
22
21
11
5
31
20
14
12
10
30
13
6
2
25
7
9
4
1
8
32
33

METHOD AND CONTROL SYSTEM FOR VERIFYING SENSOR OPERATION IN A REFRIGERATION SYSTEM

BACKGROUND OF THE INVENTION

The present invention relates to refrigeration systems and, more particularly, to methods of operating and control systems for refrigeration systems such as centrifugal vapor compression refrigeration systems.

Generally, refrigeration systems include an evaporator or cooler, a compressor, and a condenser. Usually, a heat transfer fluid is circulated through tubing in the evaporator thereby forming a heat transfer coil in the evaporator to transfer heat from the heat transfer fluid flowing through the tubing to refrigerant in the evaporator. The heat transfer fluid chilled in the tubing in the evaporator is normally water which is circulated to a remote location to satisfy a refrigeration load. The refrigerant in the evaporator evaporates as it absorbs heat from the water flowing through the tubing in the evaporator, and the compressor operates to extract this refrigerant vapor from the evaporator, to compress this refrigerant vapor, and to discharge the compressed vapor to the condenser. In the condenser, the refrigerant vapor is condensed and delivered back to the evaporator where the refrigeration cycle begins again.

Normally, sensors are provided in refrigeration systems of the type described above to sense certain refrigeration system operating conditions during normal operation of the refrigeration system. These sensors provide signals indicative of the sensed operating conditions to a control system for the refrigeration system. For example, a flow sensor may be provided to sense flow of the heat transfer fluid through the tubing in the evaporator. The control system controls various operating parameters of the refrigeration system or takes various safety control actions in response to the sensed operating condition. For example, the control system may shut down operation of the refrigeration system to prevent freezing of the heat transfer fluid in the tubing in the evaporator if no flow is sensed by the flow sensor in the tubing in the evaporator.

Operating condition sensors in refrigeration systems of the type described above must provide accurate, reliable indications of the sensed operating conditions if the refrigeration system is to operate properly. This is especially true of safety sensors to avoid needless shutdowns of the refrigeration system due to faulty sensors or faulty readings provided to the control system by the sensors.

SUMMARY OF THE INVENTION

Therefore, it is an object of the present invention to provide simple, efficient, and effective means for verifying proper operation of operating condition sensors used in a refrigeration system before startup of the refrigeration system and during operation of the refrigeration system to thereby insure that the sensors are providing accurate and reliable indications of the sensed operating conditions. This and other objects of the present invention are attained by a method of operating a control system for a refrigeration system wherein refrigeration system operating sensors are checked prior to startup of the refrigeration system and wherein out of bounds signals generated by the sensors during operation of the refrigeration system are verified before any control action is taken in response thereto. The refrigeration system startup is aborted if a faulty sensor is detected prior to startup of the refrigeration system. Out of bounds signals generated by the sensors during operation of the refrigeration system are verified by intermittently monitoring the signals provided by the sensors. No control action is initiated unless a preselected number of consecutive out of bounds signals from an operating condition sensor are detected thereby insuring that a single anomalous signal from the sensor will not result in initiation of needless control action.

BRIEF DESCRIPTION OF THE DRAWING

Still other objects and advantages of the present invention will be apparent from the following detailed description of the present invention in conjunction with the accompanying drawing in which:

The FIGURE is a schematic illustration of a centrifugal vapor compression refrigeration system with a control system for operating the refrigeration system according to the principles of the present invention.

DESCRIPTION OF THE PREFERRED EMBODIMENT

Referring to the FIGURE, a centrifugal vapor compression refrigeration system 1 is shown having a control system 3 for operating the refrigeration system 1 according to the principles of the present invention. As shown in FIG. 1, the refrigeration system 1 includes a centrifugal compressor 2, a condenser 4, an evaporator 5 and an expansion valve 6. In operation, compressed gaseous refrigerant is discharged from the compressor 2 through compressor discharge line 7 to the condenser 4 wherein the gaseous refrigerant is condensed by relatively cool condensing water flowing through tubing 8 in the condenser 4. The condensed liquid refrigerant from the condenser 4 passes through refrigerant line 9 and the expansion valve 6 to the evaporator 5. The liquid refrigerant in the evaporator 5 is evaporated to cool a heat transfer fluid, such as water, flowing through tubing 10 in the evaporator 5. This cool heat transfer fluid is used to cool a building or is used for other such purposes. The gaseous refrigerant from the evaporator 5 flows through compressor suction line 11 back to the compressor 2 under the control of compressor inlet guide vanes 12. The gaseous refrigerant entering the compressor 2 through the guide vanes 12 is compressed by the compressor 2 and discharged from the compressor 2 through the compressor discharge line 7 to complete the refrigeration cycle. This refrigeration cycle is continuously repeated during normal operation of the refrigeration system 1.

Also, as shown in the FIGURE, the centrifugal compressor 2 of the refrigeration system 1 includes an electric motor 25 for driving the compressor 2. In addition, the compressor inlet guide vanes 12 are opened and closed by a guide vane actuator 14 which is controlled by the control system 3.

The control system 3 includes a compressor motor starter 22, a power supply 23, a system interface board 16, a processor board 17 and a set point and display board 18. A temperature sensor 13 for sensing the temperature of the heat transfer fluid leaving the evaporator 5 through the tubing 10 is connected by electrical lines 20 directly to the processor board 17. Also, a flow sensor 30 for sensing the flow of the heat transfer fluid leaving the evaporator 5 through the tubing 10 is connected by electrical lines 31 directly to the processor board 17. In addition, another flow sensor 32 for sensing the flow of the heat transfer fluid leaving the condenser 4 through the tubing 8, is connected by electrical lines 33 directly to the processor board 17.

Of course, as will be readily apparent to one of ordinary skill in the art to which the present invention pertains, the temperature sensor 13 may be any of a variety of temperature sensors suitable for generating a signal indicative of the temperature of the heat transfer fluid leaving the evaporator 5 and for supplying this generated signal to the processor board. Preferably, the temperature sensor 13 is a temperature responsive resistance device such as a thermistor having its sensing portion located in the heat transfer fluid leaving the evaporator 5 with its resistance monitored by the processor board 17.

Also, as will be readily apparent to one of ordinary skill in the art to which the present invention pertains, the flow sensors 30 and 32 may be any of a variety of flow sensors suitable for providing a signal indicative of the fluid flow through the tubing 10 in the evaporator or the tubing 8 in the condenser, respectively, and for supplying a signal indicative of this sensed flow to the processor board 17. For example, each of the flow sensors 30, 32 may be a conventional paddle flow switch.

The processor board 17 may be any device, or combination of devices, for receiving a plurality of input signals, for processing the received input signals according to preprogrammed procedures, and for producing desired output control signals in response to the processed input signals, in a manner according to the principles of the present invention. For example, the processor board 17 may be a microcomputer, such as a model 8031 microcomputer available from Intel Corporation which has a place of business at Santa Clara, Calif.

The set point and display board 18 comprises a visual display, including, for example, light emitting diodes (LED) or liquid crystal display (LCD's) devices forming a multi-digit display which is under the control of the processor board 17. Also, the set point and display board 18 includes a device, such as a set point potentiometer model AW5403 available from CTS, Inc. which has a place of business at Skyland, N.C., which is adjustable to output a signal to the processor board 17 indicative of a selected set point temperature for the heat transfer fluid leaving the evaporator 5 through the tubing 10.

The system interface board 16 includes switching devices which are under the control of the processor board 17 for supplying electrical power from the power supply 23 through electrical lines 21 to the guide vane actuator 14 and from the power supply 23 through the compressor motor starter 22 to the motor 25 driving the compressor 2. Each of the switching devices on the system interface board 16 may be an electronic component such as a model SC-140 triac available from General Electric Co. which has a place of business at Auburn, N.Y.

The compressor motor starter 22 is a system for supplying electrical power received through the system interface board 16 from the power supply 23 to the electric motor 25 of the compressor 2 to start up and run the motor 25. For example, the compressor motor starter 22 may be a conventional wye-delta (Y-Δ) contactor type motor starter. Of course, as will be readily apparent to one of ordinary skill in the art to which the present invention pertains, the compressor motor starter 22 may be any one of a variety of systems for supplying electrical power from the power supply 23 to the electric motor 25 of the compressor 2 to start and run the motor 25.

In operation, the temperature sensor 13 senses the temperature of the heat transfer fluid in tubing 10 leaving the evaporator 5 and a signal indicative of this sensed temperature is supplied to the processor board 17 of the control system 3. Also, signals from the flow sensors 30 and 32 indicative of refrigerant flow through the tubing 10 in the evaporator 5 and the tubing 8 in the condenser 4, respectively, are provided to the processor board 17 of the control system 3. In addition, a signal indicative of a set point temperature is supplied from the set point and display board 18 to the processor board 17. This set point temperature is an operator selected temperature to which the heat transfer fluid leaving the evaporator 5 is to be cooled by operation of the refrigeration system 1. Thus, the temperature sensed by the temperature sensor 13 relative to the set point temperature setting of the set point and display board 18 represents a refrigeration load to be satisfied by operation of the refrigeration system 1.

The processor board 17 is programmed to compare the temperature sensed by the temperature sensor 13 to the selected set point temperature setting of the set point and display board 18. If the sensed temperature sensed by the temperature sensor 13 exceeds the set point temperature of the set point and display board 18 by a predetermined amount, the processor board 17 generates control signals to turn on the refrigeration system 1. As part of turning on the refrigeration system 1, the processor board 17 supplies electrical control signals to the system interface board 16 to close appropriate switching devices on the system interface board 16 to allow electrical power to flow from the power supply 23 through the system interface board 16 to the compressor motor starter 22 which starts and runs the electric motor 25 of the compressor 2 in the refrigeration system 1. Also, electrical power is controlled by the processor board 17 through operation of the appropriate switching devices on the system interface board 16 to supply electrical power from the power supply 23 through the system interface board 16 to the guide vane actuator 14 for driving the guide vanes 12 as desired in response to the sensed refrigeration system 1 operating conditions. Normally, the guide vanes 12 are controlled by the processor board 17 directly in response to the load placed on the refrigeration system 1.

The guide vane actuator 14 may be any device suitable for driving the guide vanes 12 towards either their fully open or fully closed position in response to electrical power signals received via the electrical lines 21. For example, the guide vane actuator 14 may be an electric motor, such as a model MC-351 motor available from the Barber-Coleman Company having a place of business in Rockford, Ill., for driving the guide vanes toward either their fully open or fully closed position depending on which one of two switching devices on the system interface board is actuated in response to control signals received by the switching devices from the processor board 17. The guide vane actuator 14 may drive the guide vanes 12 toward either their fully open or fully closed position according to any one of a variety of control schemes which will be readily apparent to one of ordinary skill in the art to which the present invention pertains.

However, according to the present invention, prior to startup of the refrigeration system 1, the processor board 17 checks to determine whether each of the operating condition sensors used in the refrigeration system 1, such as temperature sensor 13 and flow sensors 30 and 32, are providing output signals which are within normal limits. For example, the processor board 17 checks the temperature sensor 13 to determine whether the output signal provided by the temperature sensor 13 through the electrical lines 20 to the processor board 17 corresponds to a reasonable temperature value. That is, the processor board 17 checks to determine whether the temperature reading of the temperature sensor 13 is above a high limit or below a low limit which each correspond to a limit which can only be exceeded due to a malfunction of the temperature sensor 13. Also, the processor board 17 checks the output signals generated by the flow sensors 30, 32, to determine whether these output signals are within normal limits prior to startup of the refrigeration system 1.

If the processor board 17 determines that any of the output signals provided to the processor board 17 from the operating condition sensors, such as the temperature sensor 13 and the flow sensors 30, 32, are not within their expected normal limits then the processor board 17 aborts startup of the refrigeration system 1. This is accomplished by the processor board 17 opening appropriate switching devices on the system interface board 16 to prevent operation of the compressor 2 and of the guide vanes 12. The processor board 17 may also take other appropriate control action in response to determining that an output signal provided by one of the operating condition sensors is not within normal limits through control of other devices (not shown) in the refrigeration system 1. In addition, if startup of the refrigeration system 1 is aborted by the processor board 17 in response to a determination that one of the operating condition sensors is not within normal limits then the processor board 17 provides control signals to the set point and display board 18 to indicate cause of the aborted startup to an operator of the refrigeration system 1. This may be accomplished, for example, by a visual display on the set point and display board 18 flashing a two digit code.

The refrigeration system is started and placed in its normal mode of operation only after the processor board 17 determines that all of the signals from the operating condition sensors are within normal limits. Then, during the operation of the refrigeration system 1, the processor board 17 intermittently monitors the signals provided from the operating condition sensors to the processor board 17 to determine whether the operating conditions sensed by the sensors are within desired normal operating ranges. If the processor board determines and verifies that any one of the signals received from the operating condition sensors correspond to an out of bounds condition for the operating condition sensed by the sensor; that is, that the operating condition sensed by the sensor is not within a desired normal operating range, then appropriate control action is taken by the processor board 17. The processor board 17 verifies an out of bounds condition sensed by an operating sensor by sampling the signals from the operating sensors over a sufficient time period to determine whether a preselected number of consecutive determinations made by the processor board 17 all indicate that the operating condition sensed by the sensor is an out of bounds condition. For example, the processor board 17 may be programmed such that three consecutive readings of an out of bounds condition must be detected by the processor board 17 before any control action is initiated by the processor board 17.

The processor board 17 may take any of a variety of control actions in response to a detected and verified out of bounds condition sensed by an operating condition sensor depending on factors such as what operating condition is being sensed as out of bounds. For example, if the flow sensor 30 is supplying a signal to the processor board 17 indicating that there is no flow through the tubing 10 in the evaporator 5 the refrigeration system 1 may be shutdown. This is accomplished by the processor board 17 generating an alarm signal in response to which water pumps, cooling tower fans, and electrical power to the compressor 2 are discontinued. For example, in response to the alarm signal, the processor board 17 may generate an output control signal to the system interface board 16 to close the appropriate switching device on the system interface board 16 to prevent electrical power flow from the power supply 23 through the system interface board 16 and through the compressor motor starter 22 to the compressor motor 25 of the compressor 2 thereby turning off the compressor 2. In addition, in response to the alarm signal, the processor board 17 may generate an output control signal which is supplied to the set point and display board 18 to activate a visual display to indicate cause of the shutdown to an operator of the refrigeration system 1.

Thus, according to the present invention, the operating condition sensors in the refrigeration system 1 are checked prior to startup of the refrigeration system 1 and their operation is verified during normal operation of the refrigeration system 1 to thereby insure that the sensors are providing accurate and reliable indications of the sensed operating conditions. This results in improved operation of the refrigeration system 1, for example, by preventing needless shutdowns of the refrigeration system due to faulty sensors or anomalous readings provided to the control system 3 by the sensors.

Of course, the foregoing description is directed to a particular embodiment of the present invention and various modifications and other embodiments of the present invention will be readily apparent to one of ordinary skill in the art to which the present invention pertains. Therefore, while the present invention has been described in conjunction with a particular embodiment, it is to be understood that various modifications and other embodiments of the present invention may be made without departing from the scope of the invention as described herein and as claimed in the appended claims.

What is claimed is:

1. A safety control system for sensors in a refrigeration system including a compressor, a condenser, and an evaporator, comprising:

a sensor means for sensing an operating condition and for generating a signal in response to the operating condition, said sensor means having a first prescribed operating range prior to startup wherein any signal generated outside said first prescribed range indicates a malfunction of said sensor means and a second prescribed operating range during system operation wherein any preselected number of consecutive signals generated outside said second prescribed range indicates a malfunction of said sensor means, processor means connected to said sensor means for monitoring generated signals from said sensor means and for determining whether the signals are within respective said first and said second prescribed operating ranges, said processor means further generating a first alarm signal when a monitored signal falls outside said first prescribed operating range prior to startup, and generating a second alarm signal when any monitored preselected number of consecutive signals falls outside said second prescribed operating range during system operation, and safety means connected to said processor means for receiving said first and said second alarm signals, for aborting startup upon receiving said first alarm signal, and for shutting down said system upon receiving said second alarm signal, whereby shutdowns of said refrigeration system due to malfunctioning sensors is eliminated.

2. The safety control system of claim 1 further comprising indicator means connected to said processor means for generating a signal in response to said first alarm signal to indicate cause of an aborted startup.

3. The safety control system of claim 2 wherein said indicator means further generates another signal in response to said second alarm signal to indicate a cause of system shutdown.

4. The safety control system of claim 1 wherein said sensor means comprises a fluid flow sensor.

5. The safety control system of claim 1 wherein said processor means comprises a microcomputer control system.

6. The safety control system of claim 1 wherein said safety means comprises:

power supply means for supplying electrical power to a motor to operate said compressor, and switch means connected between said power supply means and said compressor motor for allowing electrical power to flow from said power supply means to said compressor motor when said switch means is closed and for preventing electrical power flow from said power supply means to said compressor motor when said switch means is open, said switch means being connected to and controlled by said processor means which closes said switch means when it is desired to operate the refrigeration system and which opens said switch means when said processor means generates said first alarm signal or said second alarm signal.

7. A method for verifying proper operation of operating condition sensors in a refrigeration system including a compressor, a condenser, an evaporator, and a safety control system having at last one sensor for sensing an operating condition and then generating an output signal in response to the sensed operating condition, the method comprising the steps of:

verifying proper operation of the sensor prior to refrigeration system startup, aborting the startup if the sensor malfunctions by generating an output signal that falls outside a first prescribed range as determined by the step of verifying, after startup, monitoring any preselected number of consecutive output signals generated by the sensor to determine whether the signals are within a second prescribed range, thereby verifying proper operation of the sensor, and shutting down the refrigeration system when the step of monitoring verifies improper operation of the sensor when the preselected number of consecutive signals fall outside the second prescribed range, whereby shutdowns of the refrigeration system due to malfunctioning sensors are eliminated.

8. The method of claim 7 further comprising a first alarm signal when the startup is aborted.

9. The method of claim 7 further comprising generating a second alarm signal when operation of the refrigeration system is shutdown.

* * * * *